US010173103B1

(12) United States Patent
Hahn

(10) Patent No.: US 10,173,103 B1
(45) Date of Patent: Jan. 8, 2019

(54) GOGGLES HAVING AN ADJUSTABLE BRIDGING MEANS

(71) Applicant: Christian Hahn, Prospect, KY (US)

(72) Inventor: Christian Hahn, Prospect, KY (US)

( * ) Notice: Subject to any disclaimer, the term of this patent is extended or adjusted under 35 U.S.C. 154(b) by 0 days.

(21) Appl. No.: 16/023,678

(22) Filed: Jun. 29, 2018

Related U.S. Application Data

(60) Provisional application No. 62/546,740, filed on Aug. 17, 2017.

(51) Int. Cl.
*A63B 33/00* (2006.01)
*A63B 31/00* (2006.01)

(52) U.S. Cl.
CPC ..... *A63B 33/002* (2013.01); *A63B 2033/008* (2013.01); *A63B 2208/03* (2013.01); *A63B 2225/09* (2013.01); *A63B 2244/20* (2013.01)

(58) Field of Classification Search
CPC ..... A63B 33/002; A63B 2033/004; A63B 2033/008; A63B 2225/09; A63B 2033/006; G02C 5/045; G02C 1/00; G02C 5/16
See application file for complete search history.

(56) References Cited

U.S. PATENT DOCUMENTS 1,838,646 A * 12/1931 Walsh, Jr. ..... G02C 5/045 2/445
2,007,186 A * 7/1935 Farrell ..... A63B 33/002 109/58.5
2,709,256 A * 5/1955 Baratelli ..... A61F 9/026 2/428
4,051,557 A * 10/1977 Bengtson ..... A63B 33/002 2/430
8,448,267 B2 * 5/2013 Hahn ..... A63B 33/002 2/452
2004/0187197 A1 * 9/2004 Chiang ..... A63B 33/002 2/445
2006/0242745 A1 * 11/2006 DiChiara ..... A63B 33/002 2/12
2006/0256279 A1 * 11/2006 Amioka ..... G02C 5/006 351/41
2013/0019386 A1 * 1/2013 Hahn ..... A63B 33/002 2/431

OTHER PUBLICATIONS

"Historical background on screw threads"; www.boltscience.com/pages/screw2.htm; copyright 1996-2018, Bolt science limited. Accessed Aug. 6, 2018.*

* cited by examiner

*Primary Examiner* — Bobby Muromoto, Jr.
(74) *Attorney, Agent, or Firm* — The Law Offices of Eric W. Peterson

(57) ABSTRACT

Swimming goggles having a first eyepiece, a second eyepiece, and a bridging means, having a first bridging member, and a second bridging member, wherein the first bridging member engages the first eyepiece, wherein the second bridging member engages the second eyepiece, and wherein the first bridging member rotationally engages the second bridging member.

27 Claims, 10 Drawing Sheets

GOGGLES HAVING AN ADJUSTABLE BRIDGING MEANS

CROSS-REFERENCE TO RELATED APPLICATION

This application claims the benefit of U.S. Provisional Application No. 62/546,740 filed on Aug. 17, 2017, which is incorporated herein by reference in its entirety.

BACKGROUND

Swimming goggles, used to cover and protect the eyes of a user, can have a pair of eyepieces disposed on a user's left and right eyes connected by a bridge commonly traversing the nose. The distance between the left and right eye of a user and the size of the bridge of a user varies, therefore an adjustable bridge is needed to accommodate for various shapes and sizes of a user's face and components thereon. Attempts have been made to allow for adjustment of the bridge to account for varying shapes and sizes. Various different types of adjustable bridges for swimming goggles have been proposed but fall short in that they cause discomfort to the user, interfere with the user's nose, inhibit the suction of the eyepieces, require too much strength to adjust thereby preventing children who lack the hand strength to adjust the length of the bridge, or inadvertently adjust while the user is wearing the swimming goggle.

SUMMARY OF THE INVENTION

The present disclosure pertains to swimming goggles having a first eyepiece, a second eyepiece, and a bridging means, having a first bridging member, and a second bridging member, wherein the first bridging member engages the first eyepiece, wherein the second bridging member engages the second eyepiece, and wherein the first bridging member rotationally engages the second bridging member. One aspect of the disclosure is swimming goggles having a first protruding member, wherein the first protruding member engages the first eyepiece and the first bridging member. Another aspect of the disclosure is swimming goggles having a second protruding member, wherein the second protruding member engages the second eyepiece and the second bridging member. Another aspect of the disclosure is swimming goggles wherein the first protruding member releaseably engages the first bridging member. Another aspect of the disclosure is swimming goggles wherein the first protruding member comprises a hole configured to receive the first bridging member.

Another aspect of the disclosure is swimming goggles wherein the second bridging member comprises a cavity defined by a cavity wall, wherein the cavity is configured to receive the first bridging member. Another aspect of the disclosure is swimming goggles wherein an exterior surface of the first bridging member has threads and wherein the cavity wall has threads. Another aspect of the disclosure is swimming goggles wherein the threads of the cavity wall are configured to engage the threads of the first bridging member. Another aspect of the disclosure is swimming goggles wherein the second bridging member further comprises a hole configured to allow water to drain from the cavity. Another aspect of the disclosure is swimming goggles wherein the hole is positioned within the side of the second bridging member. Another aspect of the disclosure is swimming goggles wherein the second bridging member further comprises a window configured to allow a user to determine the depth the first bridging member has traversed into the cavity of the second bridging member.

Another aspect of the disclosure is swimming goggles wherein the first bridging member is curved and the second bridging member is curved, wherein the angle of the curvature of the first bridging member and second bridging member is substantially the same. Another aspect of the disclosure is swimming goggles wherein the bridging means further comprises a stop mechanism. Another aspect of the disclosure is swimming goggles wherein the second bridging member comprises an interior surface, and the stop mechanism comprises a stop portion and a stop groove, wherein the stop portion engages the exterior surface of the first bridging member and wherein the stop groove is defined by the interior surface of the second bridging member. Another aspect of the disclosure is swimming goggles wherein the stop portion is a hump.

Another aspect of the disclosure is swimming goggles having a strap connector, wherein the strap connector rotationally engages the first eyepiece. Another aspect of the disclosure is swimming goggles wherein the first eyepiece comprises a cavity, wherein the cavity is configured to receive the strap connector. Another aspect of the disclosure is swimming goggles having a strap connector, wherein the strap connector releaseably engages the first eyepiece. Another aspect of the disclosure is swimming goggles wherein the first eyepiece comprises a cavity, wherein the cavity is configured to receive the strap connector.

With those and other objects, advantages and features on the invention that may become hereinafter apparent, the nature of the invention may be more clearly understood by reference to the following detailed description of the invention, the appended claims, and the drawings attached hereto.

BRIEF DESCRIPTION OF THE DRAWINGS

The accompanying drawings, which are incorporated herein and form part of the specification, illustrate various embodiments of the present invention and together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION

In the following detailed description, reference is made to the accompanying drawings which form a part hereof and in which is shown by way of illustration specific embodiments in which the invention may be practiced. These embodiments are described in sufficient detail to enable those skilled in the art to practice the invention, and it is to be understood that other embodiments may be utilized and that structural or logical changes may be made without departing from the scope of the present invention. The following detailed description is, therefore, not to be taken in a limiting sense, and the scope of the present invention is defined by the appended claims.

Figure 1:
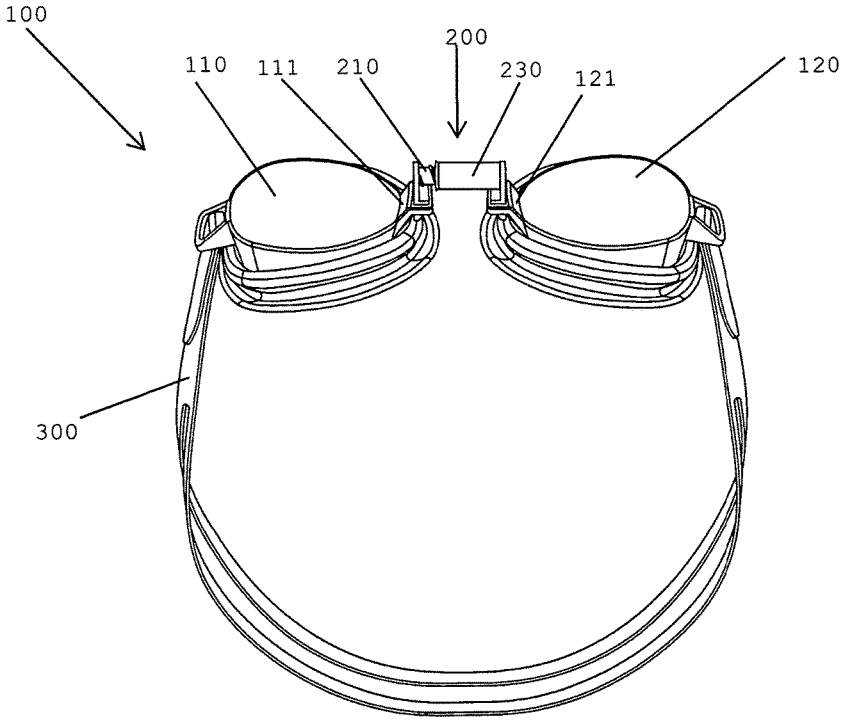
FIG. 1 is a perspective view of goggles according to an exemplary embodiment.
Figure 2:
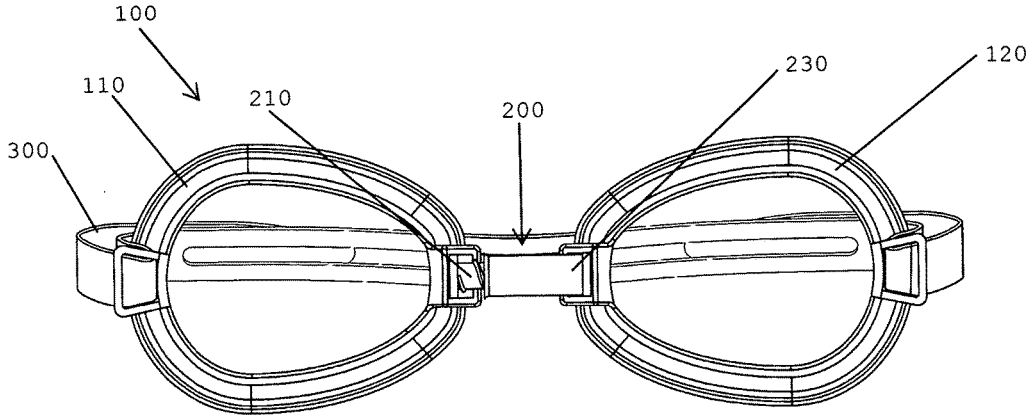
FIG. 2 is a side view of goggles according to an exemplary embodiment.

The present disclosure pertains to goggles 100 to protect the eyes from water while swimming, diving, or the like. As shown in FIGS. 1 & 2, the goggles 100 can have a first eyepiece 110, a second eyepiece 120, and a bridging means 200. In one embodiment, the goggles 100 can have a strap 300 for connecting the goggles 100 to the head of the user. The strap 300 can be connected to outer ends of the first eyepiece 110 and second eyepiece 120. The first eyepiece 110 can be positioned on the user's left eye, and the second eyepiece 120 can be positioned on the user's right eye. The first and second eyepieces 110,120 can have a symmetrical shape based on the center of the goggles 100, and are configured by the same element or component. The first and second eyepieces 110,120 can have a lens and a frame. The lens can have a circular or oval shape so as to correspond to an eye shape of the user. The frame can have a hole for receiving the lens. The lens and the frame may be integrally formed, and may be separately manufactured to be integrally coupled with each other.

The bridging means 200 can be any means for connecting a first eyepiece 110 to a second eyepiece 120. In one embodiment, the bridging means 200 can have a first bridging member 210 having, as shown in FIG. 3, a first end 211, a second end 212, and at least one side 213, and a second bridging member 230 having, a first end 231, a second end 232, and at least one side 233.

The first bridging member 210 can releaseably engage the second bridging member 230 thereby connecting the first eyepiece 110 to the second eyepiece 120. In one embodiment, the first bridging member 210 can connect to the first eyepiece 110. In one embodiment, the second bridging member 230 can connect to the second eyepiece 120. The bridging means 200 can be curved or straight. In one embodiment, where the bridging means 200 is curved, the first bridging member 210 is curved and the second bridging member 230 is curved where the angle or arc of the curvature of the first bridging member 210 and second bridging member 230 is substantially the same. The bridging means 200 can be made of flexible or ridged material, thereby allowing for the first and second eyepieces 110,120 to rotate or flex for a more accurate fit on the face of the user.

In one embodiment, the first bridging member 210 can have a first engagement member 217 and a first riser 218. In one embodiment, the first riser 218 can engage the first engagement member 217 and the first eyepiece 110. In one embodiment, the first riser 218 can fixedly or releaseably engage the first eyepiece 110. In one embodiment, the first riser 218 can engage the first engagement member 217 and the first protruding member 111. In one embodiment, the first riser 218 can fixedly or releaseably engage the first protruding member 111. The first riser 218 can releaseably engage the first protruding member 111 by a hole in the first protruding member 111 configured to receive the first riser 218.

Figure 3:
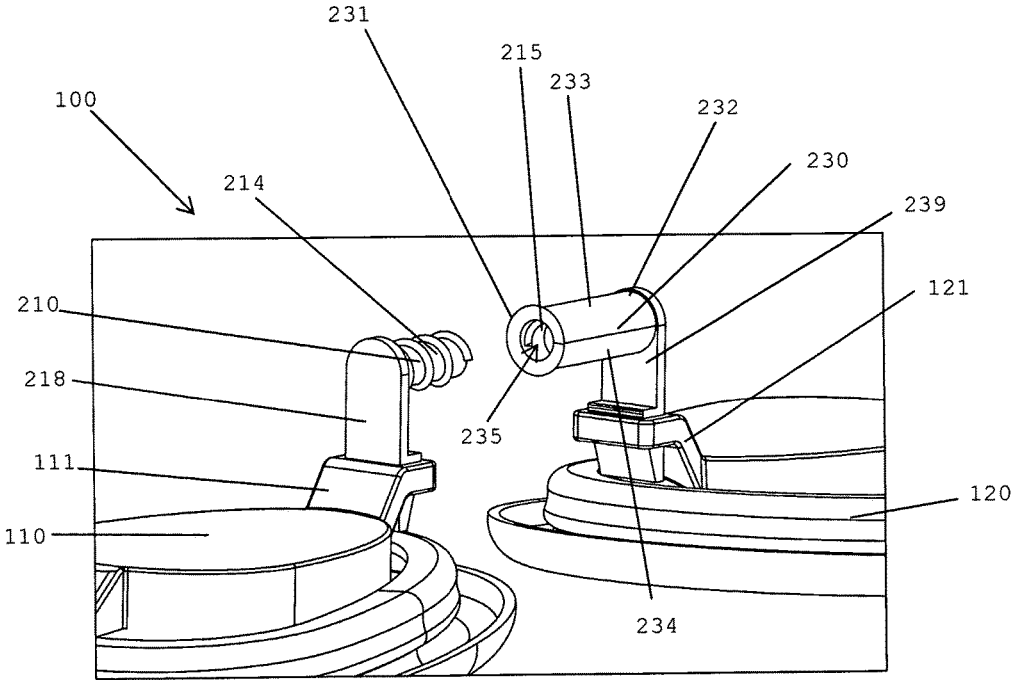
FIG. 3 is a perspective view of goggles according to an exemplary embodiment.
Figure 4:
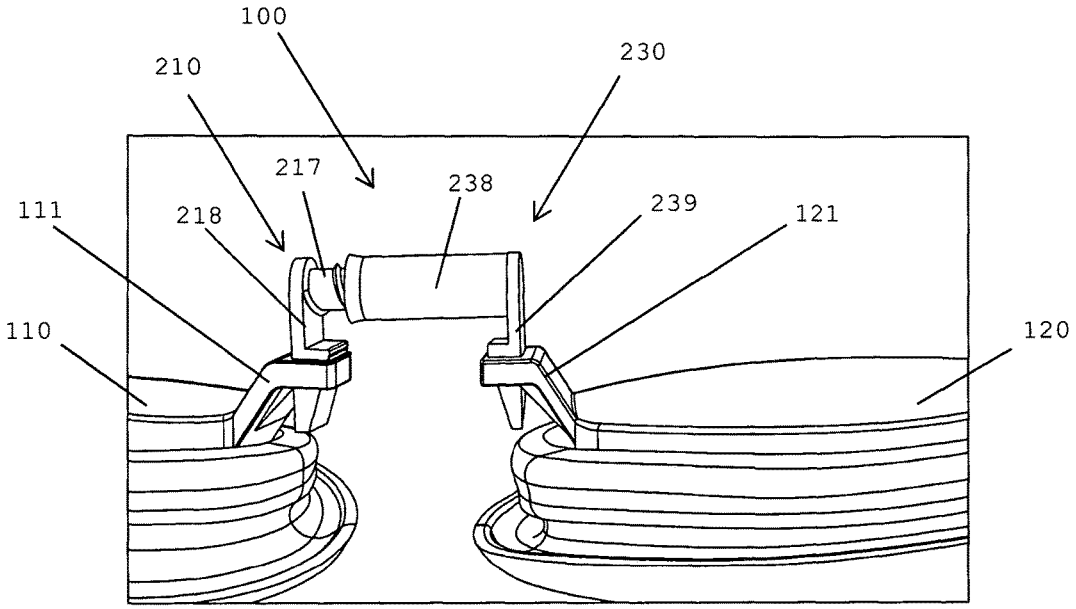
FIG. 4 is a side view of goggles according to an exemplary embodiment.
Figure 5:
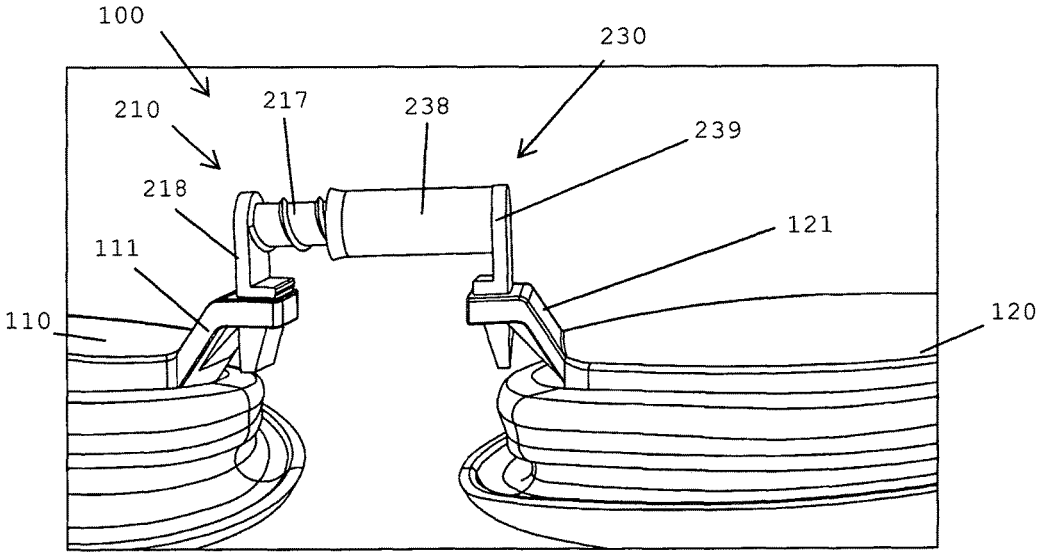
FIG. 5 is a side view of goggles according to an exemplary embodiment.

In one embodiment, as shown in FIG. 3, the second bridging member 230 comprises a cavity 235 defined by the cavity wall 234 of the second bridging member 230. The cavity 235 is configured to receive the first bridging member 210. In one embodiment, the shape of the first bridging member 210 and the cavity 235 of the second bridging member 230 are configured to allow for the second bridging member 230 to receive the first bridging member 210. For example, without limitation, the shape of the first bridging member 210 can be a cylinder and the shape of the second bridging member can be tubular corresponding to the cylindrical shape of the first bridging member 210. In one embodiment, the length of the first bridging member 210 is substantially similar to the length of the cavity 235 of the second bridging member 230. In one embodiment, the exterior surface 214 of the first bridging member 210 is threaded and the interior surface 215 of the cavity wall 234 is threaded. The threads of the exterior surface 214 of the first bridging member 210 and interior surface 215 of the cavity wall 234 are configured to allow for the first bridging member 210 to be rotated or screwed into the second bridging member 230. The threads of the cavity wall 234 are configured to engage with the threads of the first bridging member 210. By screwing the first bridging member 210 into the second bridging member 230, the first eyepiece 110 is connected to the second eyepiece 120. As shown in FIGS. 4 & 5, the threaded engagement between the first bridging member 210 and the second bridging member 230 allows for the distance between the first eyepiece 110 and second eyepiece 120 to be increased or decreased. This threaded engagement of the bridging means 200 allows for the first eyepiece 110 to be positioned at various locations in relation to the second eyepiece 120. For example, without limitation, once the first bridging member 210 is threadably secured to the second bridging member 230, the first bridging member 210 or second bridging member 230 can be rotated about the longitudinal axis of the bridging means 200 thereby either increasing or decreasing the distance between the first eyepiece 110 and the second eyepiece 120 depending on the direction of rotation. By way of further example, without limitation, rotating the first bridging member 210 clockwise in relation to the second bridging member 230 about the longitudinal axis of the bridging means 200 would allow for the distance between the first eyepiece 110 and the second eyepiece 120 to decrease to a first position while rotating the first bridging member 210 counter-clockwise about the longitudinal axis of the bridging means 200 would allow for the distance between the first eyepiece 110 and the second eyepiece 120 to increase to a second position.

Figure 6:
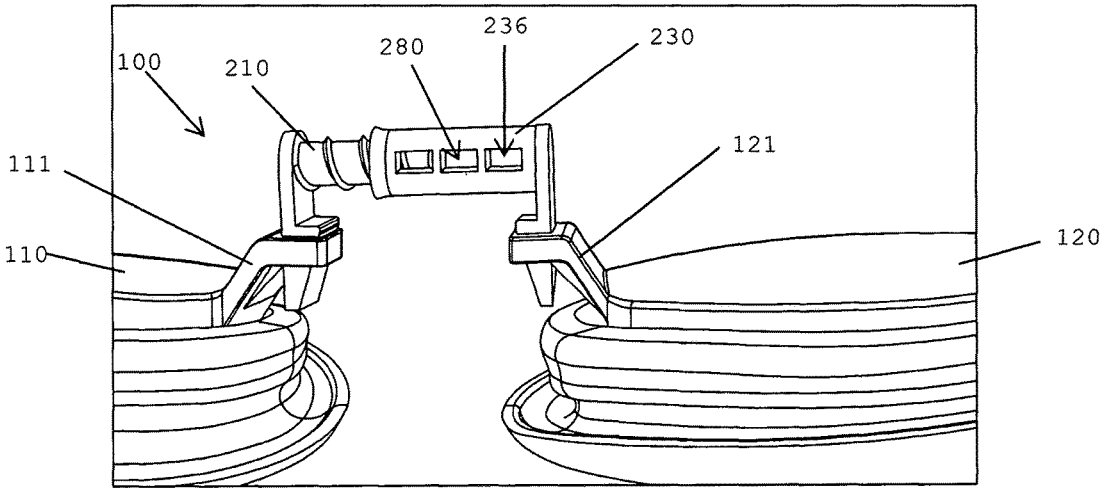
FIG. 6 is a side view of goggles according to an exemplary embodiment.

In one embodiment, as shown in FIG. 6, the second bridging member 230 can have a hole 236 configured to allow water to drain from the cavity 235 to the exterior of the second bridging member 230. The hole 236 is positioned within the cavity wall 234 where a passageway is created between the cavity 235 and the space exterior to the second bridging member 230. The hole 236 can be positioned on the side 233 of the second bridging member 230, the second end 232 of the second bridging member 230, or the like. The hole 236 can be any shape or size appropriately suited to allow for the passage of water. The second bridging member 230 can have a plurality of holes 236.

In one embodiment, the second bridging member 230 can have a window 280 configured to allow a user to visually detect or determine the depth the first bridging member 210 has traversed into the cavity 235 of the second bridging member 230. The window 280 can be any shape or size appropriately suited to allow for the a user to visually detect or determine the depth the first bridging member 210 has traversed into the cavity 235 of the second bridging member 230. In one embodiment, the hole 236 is the window 280.

In one embodiment, the second bridging member 230 can have a second engagement member 238 and a second riser 239. In one embodiment, the second riser 239 can engage the second engagement member 238 and the second eyepiece 120. In one embodiment, the second riser 239 can fixedly or releaseably engage the second eyepiece 120. In one embodiment, the second riser 239 can engage the second engagement member 238 and the second protruding member 121. In one embodiment, the second riser 239 can fixedly or releaseably engage the second protruding member 121. The second riser 239 can releaseably engage the second protruding member 121 by a hole in the second protruding member 121 configured to receive the second riser 239.

Figure 7A:
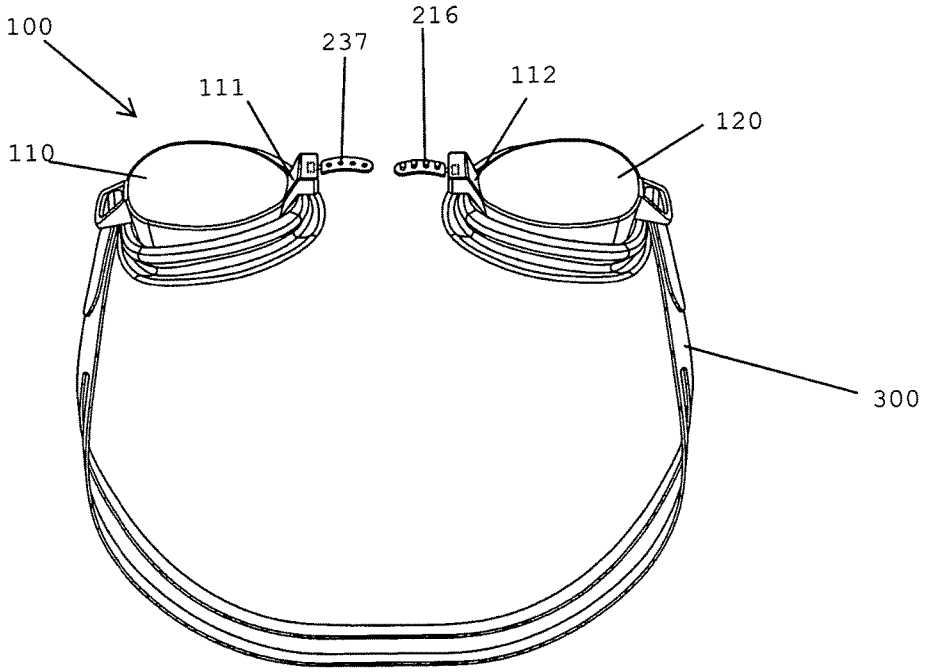
FIG. 7A is a perspective view of goggles according to an exemplary embodiment.
Figure 7B:
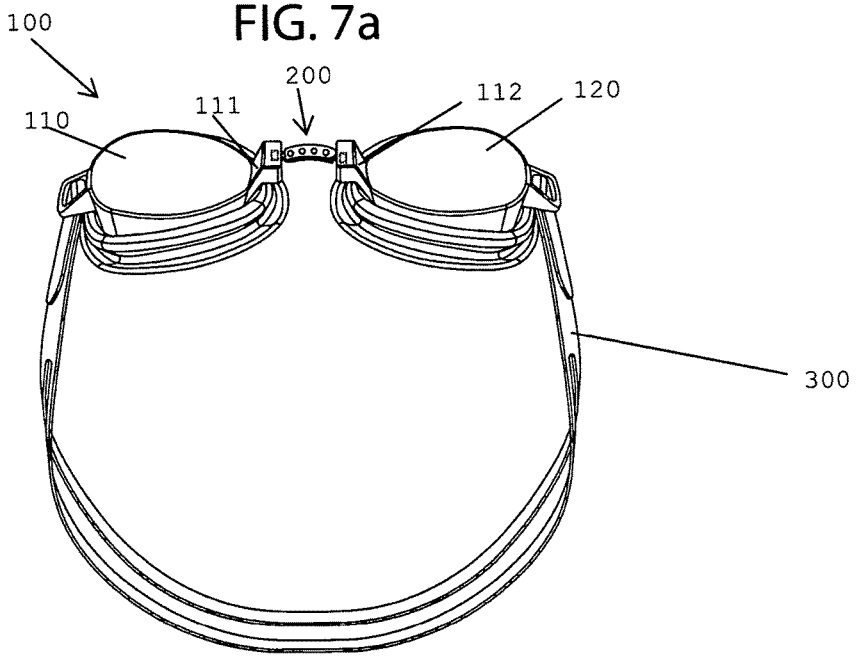
FIG. 7B is a perspective view of goggles according to an exemplary embodiment.

In one embodiment, as shown in FIGS. 7*a* and 7*b*, the first bridging member 210 has a knob hole 237 and the second bridging member 230 has a knob 216 for connecting the first eyepiece 110 to the second eyepiece 120. The knob hole 237 is configured to receive the knob 216 in a manner that allows for the first bridging member 210 to be releaseably secured to the second bridging member 230. The knob 216 can be any protrusion of the first bridging member 210. In one embodiment, the first bridging member 210 comprises at least two knobs holes 237 and the second bridging member 230 comprises at least two knobs 216, wherein the knob holes 237 are positioned on the first bridging member 210 and the knobs 216 are positioned on the second bridging member 230 at predetermined intervals or equal intervals in a length direction of the bridging means 200. In one embodiment, at least a first knob hole 237 can receive a first knob 216 and at least a second knob hole 237 can receive a second knob 216.

Figure 8A:
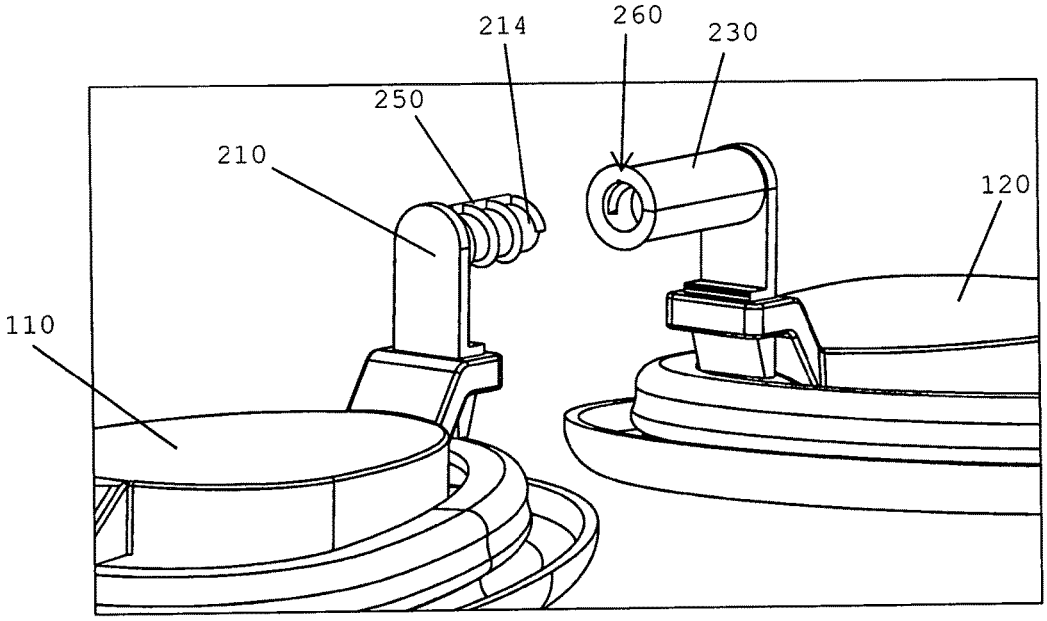
FIG. 8A is a perspective view of goggles according to an exemplary embodiment.
Figure 8B:
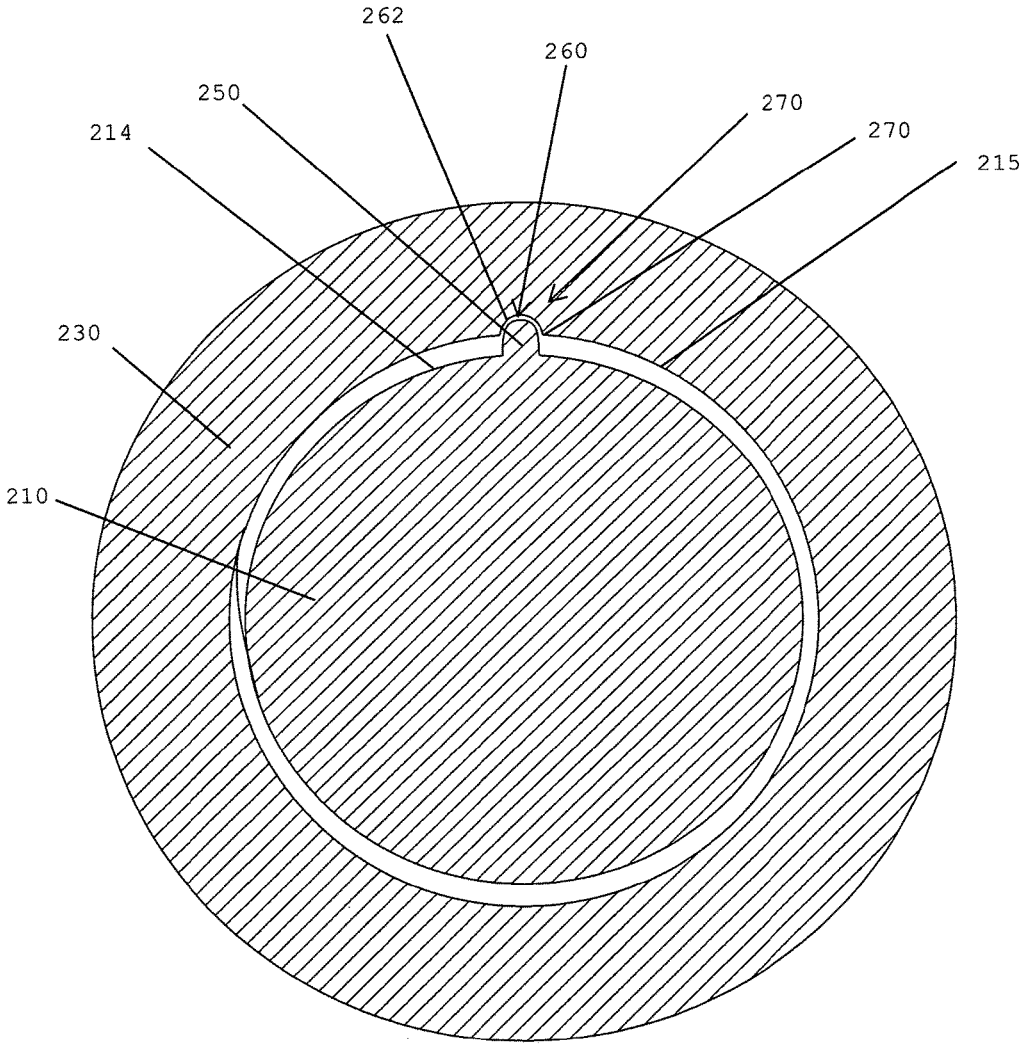
FIG. 8B is a cross-sectional view of the bridging means according to an exemplary embodiment.

In one embodiment, as shown in FIGS. 8*a* & 8*b*, the bridging means 200 can have a stop mechanism 240 for hindering the first bridging member 210 from rotating in relation to the second bridging member 230 and/or preventing the first bridging member 210 from freely rotating in relation to the second bridging member 230. This allows for the eyepieces 110,120 to remain substantially within the same orientation and/or within the same plane when the user is not applying a rotational force to the first bridging member 210. The stop mechanism 240 allows for the first bridging member 210 to rotate in relation to the second bridging member 230 upon the user applying a rotational force to the first bridging member 210. In one embodiment, the stop mechanism 240 hinders and/or prevents rotation by creating resistance within the bridging means 200, for example, without limitation, the resistance between the first bridging member 210 and the second bridging member 230.

In one embodiment, as shown in FIGS. 8*a* & 8*b*, the stop mechanism 240 can have a stop portion 250. The stop portion 250 can engage the exterior surface 214 of the first bridging member 210. The stop portion 250 can protrude beyond the exterior surface 214 of the first bridging member 210. While the stop portion 250 can be any shape or size that allows for resistance within the bridging means 200, the stop portion 250 is preferably a hump extending the longitudinal length of the first bridging member 210.

In one embodiment, as shown in FIGS. 8*a* & 8*b*, the stop mechanism 240 can have a stop groove 260. The stop groove 260 can be a recess or depression defined by the interior surface 215 of the second bridging member 230. The stop groove 260 can be configured to receive the stop portion 250. While the stop groove 260 can be any shape or size that substantially corresponds to the shape and size of the stop portion 250, the stop groove 260 is preferably a channel configured to receive the hump of the stop portion 250.

In one embodiment, as shown in FIGS. 8*a* & 8*b*, the stop mechanism 240 can have at least one stop edge 270 defined by the intersection of the interior surface 215 of the second bridging member 230 and the groove surface 262, or the portion of the interior surface 215 of the second bridging member 230 defining the stop groove 260. The stop edge 270 can provide resistance for the bridging means 200. For example, without limitation, upon rotation of the first bridging member 210 in relation to the second bridging member 230, the stop portion 250 is rotated whereby the stop portion 250 applies a force to the stop edge 270 and the stop edge 270 creates resistance between the stop edge 270 and the stop portion 250, thereby hindering rotation and/or preventing free rotation of the first bridging member 210 in relation to the second bridging member 230.

In use, where the user desires to increase or decrease the length of the bridging means 200, the user rotates the first bridging member 210 in relation to the second bridging member 230. Upon the stop groove 260 receiving the stop portion 250, the first bridging member 210 is prevented from freely rotating in relation to the second bridging member 230. Upon applying a rotational force to the first bridging member 210, the stop portion 250 is rotated past the stop edge 270. The first bridging member 210 can be rotated until a complete rotation occurs and the stop portion 250 is again received by the stop groove 260.

In one embodiment, the goggles 100 can have a first protruding member 111. The first protruding member 111 can connect to the first eyepiece 110 and the bridging means 200. In one embodiment, the first protruding member 111 can connect to the first bridging member 210. While the first protruding member 111 can engage the first bridging member 210 at any angle, for example, without limitation, between 0 and 180 degrees, such as 30, 45, 60, 75, 90 105, 120, 135, 150, 165, and 180 degrees, the first protruding member 111 preferably engages the first bridging member 210 at an angle of 90 degrees.

In one embodiment, the goggles 100 can have a second protruding member 121. The second protruding member 121 can connect to the second eyepiece 120 and the bridging means 200. In one embodiment, the second protruding member 121 can connect to the second bridging member 230. The second protruding member 121 can engage the second bridging member 230 at a substantially normal angle. While the second protruding member 121 can engage the second bridging member 230 at any angle, for example, without limitation, between 0 and 180 degrees, such as 30, 45, 60, 75, 90 105, 120, 135, 150, 165, and 180 degrees, the second protruding member 121 preferably engages the second bridging member 230 at an angle of 90 degrees.

Figure 9:
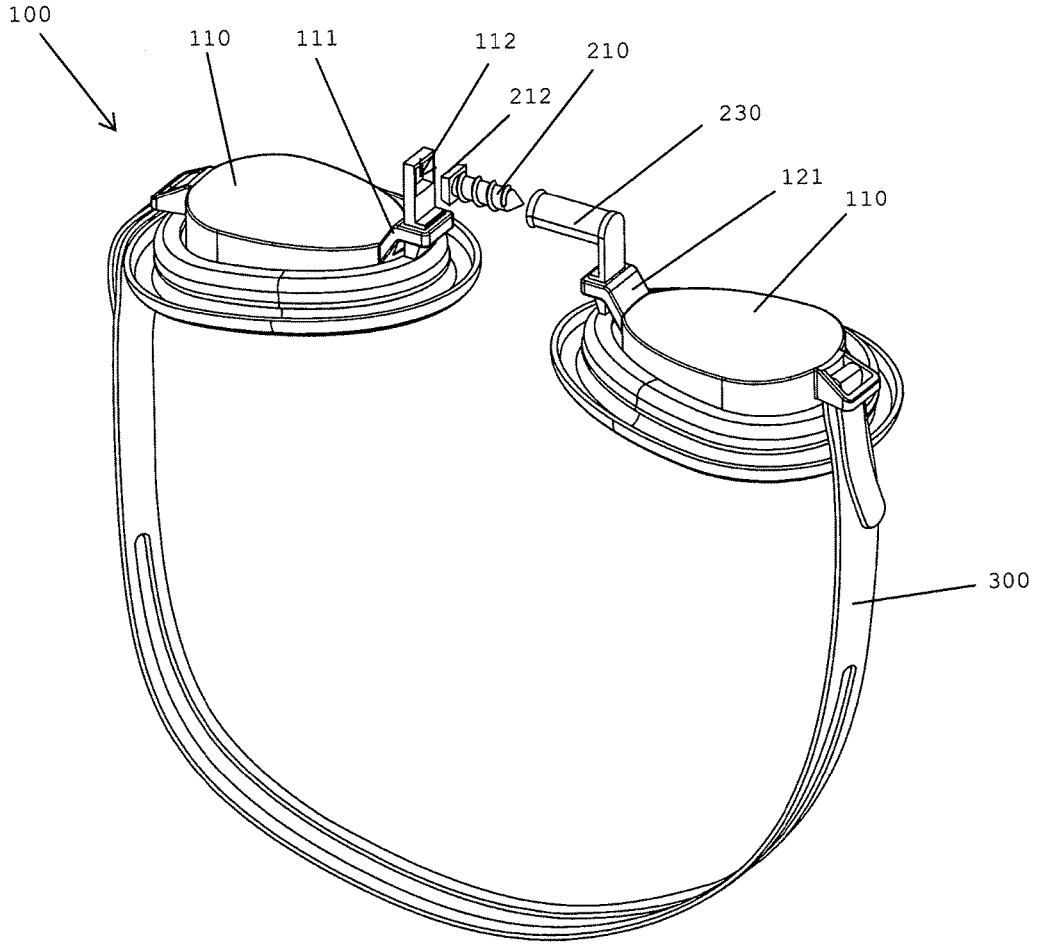
FIG. 9 is an exploded view of goggles according to an exemplary embodiment.

In one embodiment, the first protruding member 111 is releaseably engaged to the bridging means 200. In one embodiment, as shown in FIG. 9, the first protruding member 111 is releaseably engaged to the first bridging member 210. In one embodiment, the first protruding member 111 has a hole 112 configured to receive the second end 212 of the first bridging member 210. In one embodiment, the second end 212 of the first bridging member 210 comprises a square configuration and the hole 112 of the first protruding member 111 comprises a square configuration, wherein the square configuration of the hole 112 of the first protruding member 111 and square configuration of the second end 212 of the first bridging member 210 prevents the first bridging member 210 from rotating within the hole 112 of the first protruding member 111.

In one embodiment, the second protruding member 121 is releaseably engaged to the bridging means 200. In one embodiment, the second protruding member 121 is releaseably engaged to the second bridging member 230. In one embodiment, the second protruding member 121 has a hole 122 configured to receive the second end 232 of the second bridging member 230. In one embodiment, the second end 232 of the second bridging member 230 comprises a square configuration and the hole 122 of the second protruding member 121 comprises a square configuration, wherein the square configuration of the hole 122 of the second protruding member 121 and square configuration of the second end 232 of the second bridging member 230 prevents the second bridging member 230 from rotating within the hole 122 of the second protruding member 121.

Figure 10:
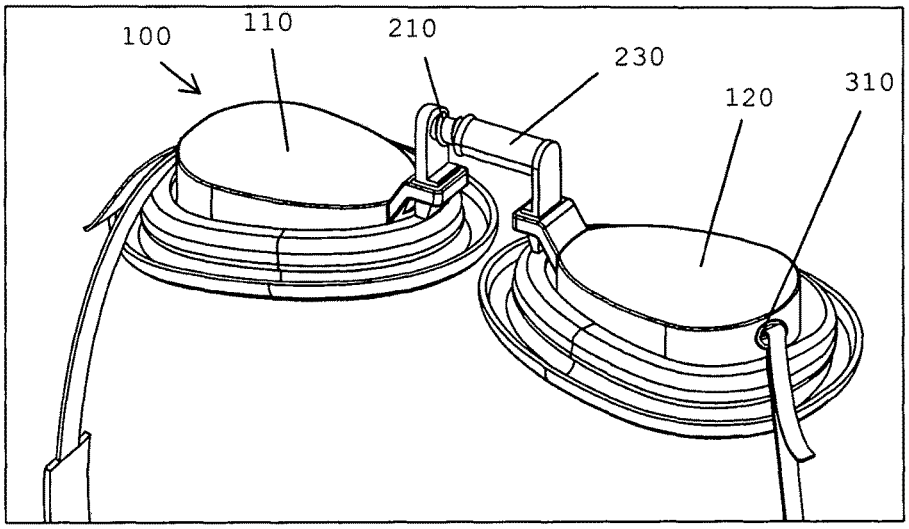
FIG. 10 is a perspective view of goggles according to an exemplary embodiment.

In one embodiment, as shown in FIG. 10, the goggles 100 can have at least one strap connector 310 configured to engage the strap 300 to the first eyepiece 110 or second eyepiece 120. The strap connector 310 can connect to the first eyepiece 110 or second eyepiece 120, and connect to the strap 300. The strap connector 310 can be fixedly, rotatably, or releaseably connected with the first eyepiece 110 or second eyepiece 120.

A rotatable strap connector 310 allows for the strap connector 310 to rotate in relation to the first eyepiece 110 or second eyepiece 120. Where the first and second bridging members 210, 230 are threaded thereby allowing for the first and second bridging members 210, 230 to be screwed together, the strap 300 can become twisted as a result of screwing the first bridging member 210 into the second bridging member 230. The rotatable strap connector 310 allows for the strap 300 to be untwisted.

Figure 11:
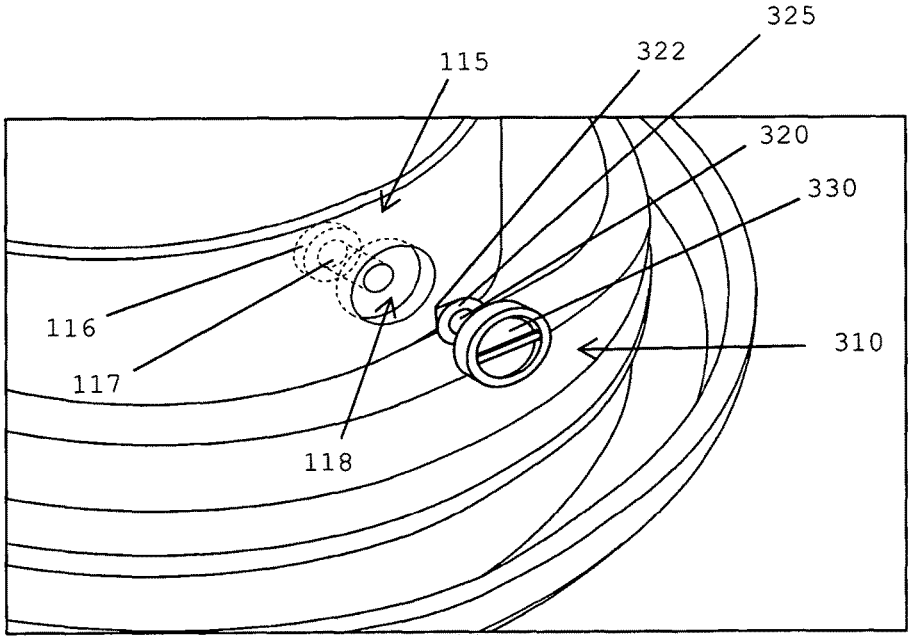
FIG. 11 is a perspective view of the strap connector according to an exemplary embodiment.

The strap connector 310 can rotatably engage the first eyepiece 110 by any conventional means. By way of example, without limitation, as shown in FIGS. 10 & 11, where the strap connector 310 rotatably connects to a first eyepiece 110, the strap connector 310 can have a protrusion 320 and a connector member 330. In one embodiment, the first eyepiece 110 can have a cavity 115 configured to receive at least a portion of the strap connector 310. In one embodiment, the protrusion 320 can have a first end 321 that connects to the strap connector 310, a second end 322, and a rod 323. The second end 322 can have an enlarged portion 325 whereby the enlarged portion 325 can have a cross-sectional radius greater than the cross-sectional radius of the rod 323.

In one embodiment, the cavity 115 can have a distal cavity 116, a passageway 117, a proximate cavity 118, or any combination thereof. The cross-sectional diameter of the distal cavity 116 can be greater than the cross-sectional diameter of the passageway 117. The distal cavity 116 can be configured to receive the enlarged portion 325 of the protrusion 320 and the passageway 117 is configured to receive the rod 323 of the protrusion 320. Where the distal cavity 116 receives the enlarged portion 325, the distal cavity 116 prevents the protrusion 320 from sliding out of the distal cavity 116 and/or passageway 117 thereby rotationally securing the strap connector 310 to the first eyepiece 110. While the protrusion 320 can be any shape that allows for the protrusion 320 to rotate within the distal cavity 116 and/or passageway 117, the protrusion 320 preferably has the cross-sectional shape of a circle. In one embodiment, the enlarged portion 325 can be tapered toward the second end 322.

While the distal cavity 116 and/or passageway 117 can be any shape that allows for the protrusion 320 to rotate within the distal cavity 116 and/or passageway 117, the distal cavity 116 and/or passageway 117 preferably have a cross-sectional shape of a circle.

In one embodiment, the proximate cavity 118 is configured to receive at least a portion of the connector member 330. While the connector member 330 can be any shape that allows for the connector member 330 to rotate within the proximate cavity 118, the connector member 330 preferably has the cross-sectional shape of a circle. While the proximately cavity 118 can be any shape that allows for the connector member 330 to rotate within the proximate cavity 118, the proximate cavity 118 preferably has a cross-sectional shape of a circle.

A releaseable strap connector 410 allows for the strap connector 410 to disengage from the first eyepiece 110 or second eyepiece 120. Where the strap 300 becomes twisted as a result of screwing the first bridging member 210 into the second bridging member 230, the disengagement of the releaseable strap connector 410 allows for the strap 300 to be untwisted.

Figure 12:
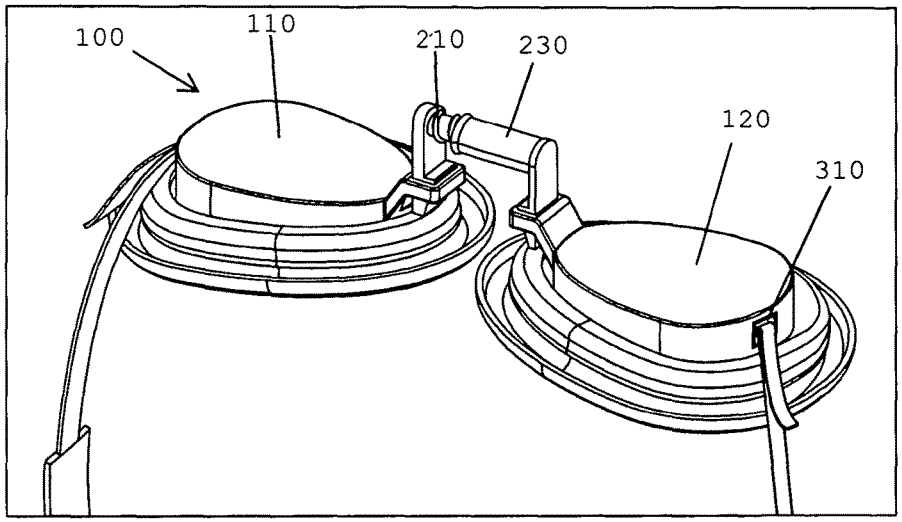
FIG. 12 is a perspective view of goggles according to an exemplary embodiment.
Figure 13:
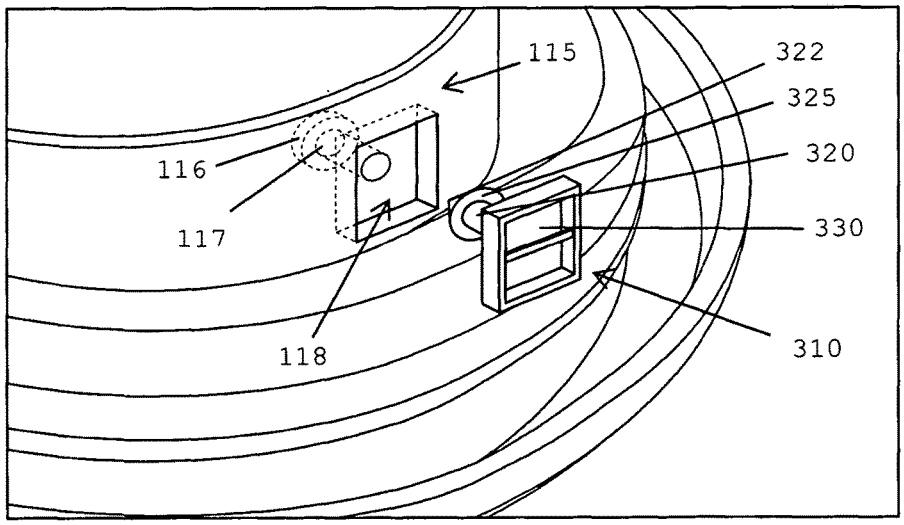
FIG. 13 is a perspective view of the strap connector according to an exemplary embodiment.

The strap connector 410 can releaseably engage the first eyepiece 110 by any conventional means. By way of example, without limitation, as shown in FIGS. 12 & 13, where the strap connector 410 releaseably connects to a first eyepiece 110, the strap connector 410 can have a protrusion 420 and a connector member 430. In one embodiment, the cavity 115 is configured to receive at least a portion of the strap connector 410. The protrusion 420 can have a first end 421 that connects to the strap connector 410, a second end 422, and a rod 423. The second end 422 can have an enlarged portion 425 whereby the enlarged portion 425 can have a cross-sectional radius greater than the cross-sectional radius of the rod 423.

In one embodiment, the cavity 115 can have a distal cavity 116, a passageway 117, a proximate cavity 118, or any combination thereof. The cross-sectional diameter of the distal cavity 116 can be greater than the cross-sectional diameter of the passageway 117. The distal cavity 116 can be configured to receive the enlarged portion 425 of the protrusion 420 and the passageway 117 is configured to receive the rod 423 of the protrusion 420. Where the distal cavity 116 receives the enlarged portion 425, the distal cavity 116 hinders the protrusion 420 from sliding out of the distal cavity 116 and/or passageway 117, thereby releaseably securing the strap connector 410 to the first eyepiece 110. However, the enlarged portion 425 is sized to allow for a user to remove the enlarged portion 425 from the distal cavity 116 by applying a force to the strap connector 410 that pulls the strap connector 410 away from the eye pieces 110, thereby disengaging the strap connector 410 from the eye piece 110. While the protrusion 420 can be any shape that allows for the protrusion 420 to be releaseably secured with the distal cavity 116 and/or passageway 117, the protrusion 420 preferably has the cross-sectional shape of a square. In one embodiment, the enlarged portion 425 can be tapered toward the second end 422.

The distal cavity 116 and/or passageway 117 can have any cross-sectional shape that allows for the protrusion 420 to be releaseably secured within the distal cavity 116 and/or passageway 117. For example, without limitation, where the enlarged portion 425 has a cross-sectional shape of a square, the distal cavity 116 has a cross-sectional shape of a square.

In one embodiment, the proximate cavity 118 is configured to receive at least a portion of the connector member 430. While the connector member 430 can be any shape that allows for the rotation of the connector member 430 within the proximate cavity 118 to be hindered, the connector member 430 preferably has the cross-sectional shape of a circle. While the proximately cavity 118 can be any shape that allows for the rotation of the connector member 430 within the proximate cavity 118 to be hindered, the proximate cavity 118 preferably has a cross-sectional shape of a circle.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "engaged" with another element, it can be fixedly engaged to the other element or releaseably engaged to the other element. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

The foregoing has described the principles, embodiments, and modes of operation of the present invention. However, the invention should not be construed as being limited to the particular embodiments described above, as they should be regarded as being illustrative and not as restrictive. It should be appreciated that variations may be made in those embodiments by those skilled in the art without departing from the scope of the present invention.

Modifications and variations of the present invention are possible in light of the above teachings. It is therefore to be understood that the invention may be practiced otherwise than as specifically described herein.

What is claimed is:

1. Swimming goggles comprising:
a first eyepiece,
a second eyepiece, and
a bridging means, comprising:
a first bridging member comprising an exterior surface,
a second bridging member comprising an interior surface, and
a stop mechanism,
wherein the first bridging member engages the first eyepiece, wherein the second bridging member engages the second eyepiece, wherein the first bridging member rotationally engages the second bridging member, wherein the stop mechanism is configured to releaseably secure the first eyepiece and the second eyepiece in at least one position, and wherein the position of the first eyepiece and the position of the second eyepiece are substantially within a same plane.

2. The swimming goggles of claim 1 further comprising a first protruding member, wherein the first protruding member engages the first eyepiece and the first bridging member.

3. The swimming goggles of claim 2 further comprising a second protruding member, wherein the second protruding member engages the second eyepiece and the second bridging member.

4. The swimming goggles of claim 2 wherein the first protruding member releaseably engages the first bridging member.

5. The swimming goggles of claim 4 wherein the first protruding member comprises a hole configured to receive the first bridging member.

6. The swimming goggles of claim 1 wherein the second bridging member comprises a cavity defined by a cavity wall, wherein the cavity is configured to receive the first bridging member.

7. The swimming goggles of claim 6 wherein an exterior surface of the first bridging member has threads and wherein the cavity wall has threads.

8. The swimming goggles of claim 7 wherein the threads of the cavity wall are configured to engage the threads of the first bridging member.

9. The swimming goggles of claim 6 wherein the second bridging member further comprises a hole configured to allow water to drain from the cavity.

10. The swimming goggles of claim 9 wherein the hole is positioned within the side of the second bridging member.

11. The swimming goggles of claim 6 wherein the second bridging member further comprises a window configured to allow a user to determine the depth the first bridging member has traversed into the cavity of the second bridging member.

12. The swimming goggles of claim 1 wherein the first bridging member is curved and the second bridging member is curved, wherein the angle of the curvature of the first bridging member and second bridging member is substantially the same.

13. Swimming goggles comprising
a first eyepiece,
a second eyepiece, and
a bridging means, comprising:
a first bridging member comprising an exterior surface,
a second bridging member comprising an interior surface,
a stop mechanism,
a strap connector, and
a strap,
wherein the first bridging member engages the first eyepiece, wherein the second bridging member engages the second eyepiece, wherein the first bridging member rotationally engages the second bridging member, wherein the strap engages the first eyepiece and the second eyepiece, wherein the strap is twisted as a result of the rotation of the first bridging member in relation to the second bridging member,
wherein the strap connector is configured to engage the first eyepiece to allow for the strap to untwist.

14. The swimming goggles of claim 13 wherein the first eyepiece comprises a cavity, wherein the cavity is configured to receive the strap connector.

15. The swimming goggles of claim 13 wherein the strap connector releaseably engages the first eyepiece.

16. The swimming goggles of claim 15 wherein the first eyepiece comprises a cavity, wherein the cavity is configured to receive the strap connector.

17. The swimming goggles of claim 1 wherein the stop mechanism is configured to releaseably secure the first eyepiece and the second eyepiece into at least a first position and a second position, wherein in the first position the position of the first eyepiece and the position of the second eyepiece are substantially within a same plane, wherein in the second position the position of the first eyepiece and the position of the second eyepiece are substantially within a same plane, and wherein the plane of the first position is substantially the same plane as the plane of the second position.

18. The swimming goggles of claim 17 wherein the plane is substantially vertical.

19. The swimming goggles of claim 17 wherein the stop mechanism is configured to allow for the position of the first eyepiece and the second eyepiece to change from the first position to the second position upon rotation of the first bridging member in relation to the second bridging member.

20. The swimming goggles of claim 19 wherein the rotation is 360 degrees.

21. The swimming goggles of claim 17 wherein the stop mechanism comprises a stop portion and stop groove, wherein the stop groove is configured to receive the stop portion, and wherein upon the stop groove receiving the stop portion, the position of the first eyepiece and the position of the second eyepiece are substantially within the same plane.

22. The swimming goggles of claim 21 wherein the stop portion engages the exterior surface of the first bridging member, and wherein the stop groove is defined by the interior surface of the second bridging member.

23. The swimming goggles of claim 21 wherein the stop portion is a protrusion extending beyond the exterior surface of the first bridging member.

24. The swimming goggles of claim 21 wherein the stop groove is a depression within the interior surface of the second bridging member.

25. The swimming goggles of claim 13 wherein the strap connector rotationally engages the first eyepiece.

26. The swimming goggles of claim 25 wherein the first eyepiece comprises a cavity and an opening, wherein the opening leads to the cavity, wherein the strap connector comprises a connector member and an enlarged portion, wherein the cavity is configured to receive the enlarged portion, wherein the enlarged portion is configured to prevent the strap connector from sliding out of the cavity, and wherein the connector member is configured to engage the strap.

27. The swimming goggles of claim 25 wherein the cross-sectional radius of the enlarge portion is greater than the cross-sectional radius of the opening.

* * * * *